US006535166B1

(12) United States Patent
Ali

(10) Patent No.: US 6,535,166 B1
(45) Date of Patent: Mar. 18, 2003

(54) CAPACITIVELY COUPLED PLATED ANTENNA

(75) Inventor: Mohammod Ali, Cary, NC (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/756,079

(22) Filed: Jan. 8, 2001

(51) Int. Cl.[7] ..... H01Q 1/38; H01Q 1/24
(52) U.S. Cl. ..... 343/700 MS; 343/702
(58) Field of Search ..... 343/700 MS, 702, 343/846, 850; 455/90; H01Q 1/38, 1/24

(56) References Cited

U.S. PATENT DOCUMENTS 5,905,467 A * 5/1999 Narayanaswamy et al. . 343/702
2001/0021643 A1 * 9/2001 Itoh ..... 343/702

FOREIGN PATENT DOCUMENTS

WO WO 00/30267 5/2000

* cited by examiner

*Primary Examiner*—Hoanganh Le
(74) *Attorney, Agent, or Firm*—Coats & Bennett, P.L.L.C.

(57) ABSTRACT

An antenna is provided for use in a wireless communications device having receive and transmit circuitry within a housing for receiving and transmitting radio signals. The antenna is built into the housing of the wireless communications device. A coupling plate is provided within the housing for transferring received and transmitted radio signals between the antenna and the receive and transmit circuitry. The coupling plate is connected to the receive and transmit circuitry and spaced from the antenna by a distance $h_1$, such that the received and transmitted radio signals are transferred between the antenna and the receive and transmit circuitry only by capacitive coupling between the antenna and the coupling plate.

19 Claims, 6 Drawing Sheets

CAPACITIVELY COUPLED PLATED ANTENNA

FIELD OF THE INVENTION

The present invention is directed toward capacitively coupled plated antennas for use in wireless communications devices and, more particularly, toward capacitively coupled plated antennas for Bluetooth or GPS (Global Positioning System) applications.

BACKGROUND OF THE INVENTION

Wireless communications devices are widely used for both wireless voice and data communications. Such wireless communications devices typically include, but are not limited to, analog and digital cellular phones, wireless phone handsets, wireless communicators, personal computers and laptops equipped with wireless modems, Personal Digital Assistants (PDAs), and other wireless electronic devices. The development and refinement of wireless communications devices continues to occur at an extremely rapid pace. Some of the problems associated with the development and refinement of wireless communications devices relate to the cost, size and complexity of the device.

As wireless communications devices become smaller and smaller, as typically occurs with each new generation cellar phone, the allotted space within the wireless communications device must continually be more efficiently utilized. Such spacial concerns typically involve considerations relating to the size of the antenna and the size and layout of elements on the printed circuit (PC) board. In most wireless communications devices, and in particular cellular phones, various internal components of the device are mounted to the PC board housed within the device. Antennas can be internal to the wireless communications device or external. External antennas are generally obtrusive, while internal antennas typically require PC board space. Further, since both internal and external antennas are directly connected to the RF (Radio Frequency) feed, they may require lumped element matching components for antenna impedance matching purposes which occupy further PC board space.

For example, for short-range applications, such as Bluetooth applications, an external stub antenna may be utilized that is printed on the same flex-film substrate on which there is the main triple-band antenna. Antennas, such as a printed inverted-F antenna, may also be directly printed on the PC board in Bluetooth applications. A drawback of these antennas is that they occupy a volume of the PC board, and require a window on the PC board around the antenna where no metallic objects are permitted in order to radiate efficiently. In long-range applications, such as GPS applications, surface mount printed inverted-F antennas may be utilized, as well as external quadrifilar helix antennas, external patch antennas, and internal notch antennas. However, each of these different types of antennas exhibits the same problems as previously noted. The external antennas are obtrusive and the internal ones require additional PC board space, and since each antenna is directly connected to the RF feed they may require lumped element matching components occupying further PC board space.

The present invention is directed toward overcoming one or more of the above-mentioned problems.

SUMMARY OF THE INVENTION

The present invention overcomes the above-described problems, and achieves other advantages, by providing an internal antenna that requires minimal PC board space and is not directly connected to any components in the wireless communications device. The general configuration of the antenna is such that it is self-matched and, accordingly, no element matching components are required.

According to an exemplary embodiment of the present invention, an antenna is provided for use in a wireless communications device having receive and transmit circuitry within a housing for receiving and transmitting radio signals. The antenna is built into the housing of the wireless communications device. A coupling plate is provided within the housing for transferring received and transmitted radio signals between the antenna and the receive and transmit circuitry. The coupling plate is connected to the receive and transmit circuitry and spaced from the antenna by a distance $h_1$, such that the received and transmitted radio signals are transferred between the antenna and the receive and transmit circuitry only by capacitive coupling between the antenna and the coupling plate.

In one form, the distance $h_1$, between the coupling plate and the antenna is equal to 1–3 mm. This enables the inventive antenna to be utilized for short-range applications using wireless communications protocol, such as the well known Bluetooth protocol that defines a radio interface in the 2.4–2.485 GHz frequency band of operation, and also for long-range GPS applications having an operating frequency of 1.57542 GHz with some operating bandwidth for tolerance.

In another form, the antenna is formed on an inner surface of the housing and, further, is formed by either plating, vacuum evaporation, adhering a metal plate onto the inner surface of the housing, or other conventional means. To avoid having to incorporate antenna impedance matching components into the device, the geometry of the antenna is such that it is impedance matched to the receive and transmit circuitry.

The antenna may include first and second antenna elements, with the first antenna element formed on the housing at a position corresponding to the coupling plate. The first antenna element and the coupling plate typically have the same geometric shape, consisting of a square, a circle, a triangle, or any other geometric configuration suitable for an appropriate wireless application.

Wireless communications devices typically include a PC board having the receive and transmit circuitry thereon, as well as other components and elements. In one form, the coupling plate is spaced from the PC board by a distance $h_2$. This enables RF circuit components to be placed on the PC board underneath the coupling plate. In a preferred form, the distance $h_2$ between the PC board and the coupling plate is equal to 1–4 mm.

It is an object of the present invention to provide a plated antenna for a wireless communications device which occupies minimal PC board space.

It is a further object of the present invention to provide an antenna for wireless communications device which is neither connected to RF nor ground.

It is still a further object of the present invention to provide an antenna for a wireless communications device having reduced cost and complexity.

It is yet a further object of the present invention to provide an antenna for a wireless communications device which does not require additional impedance matching element components.

Other aspects, objects and advantages of the present invention can be obtained from the study of the application, the drawings, and the appended claims.

DETAILED DESCRIPTION OF THE INVENTION

Figure 1A:
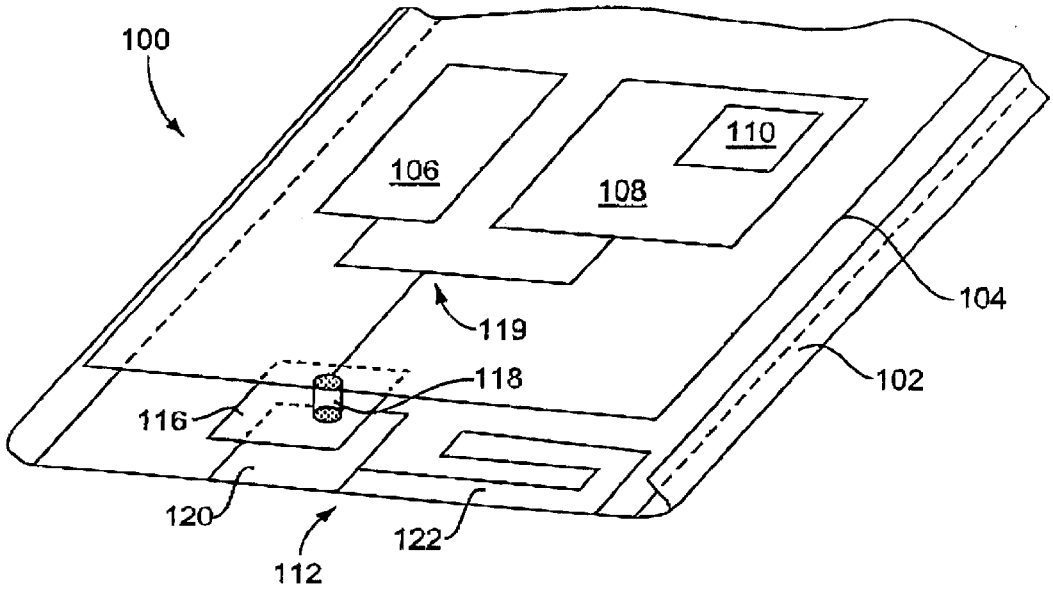
FIG. 1 is a partial sectional view of a wireless communications device incorporating the inventive antenna.
Figure 1B:
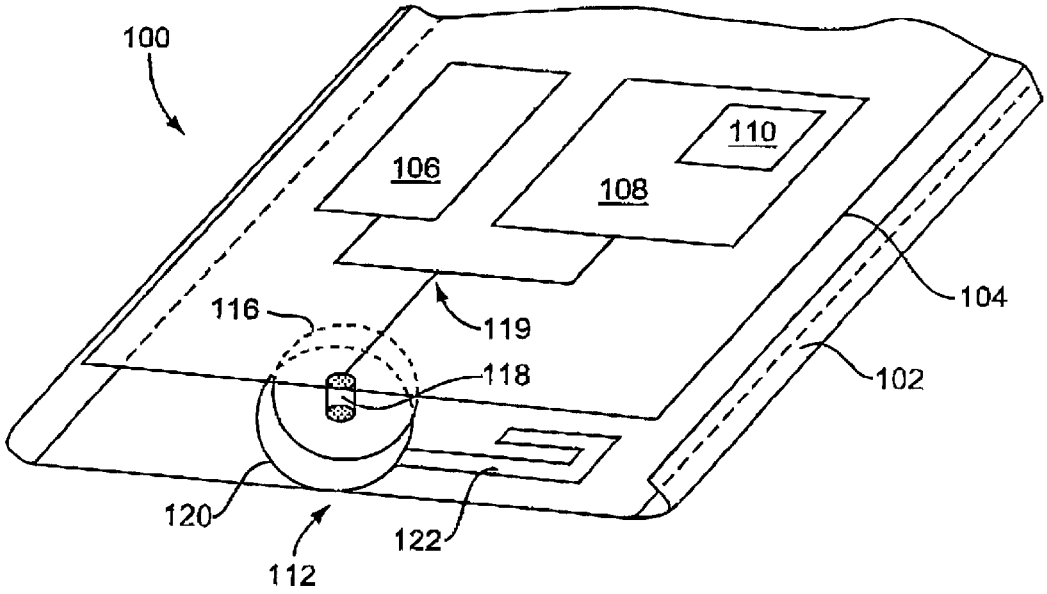

Referring to FIG. 1, a wireless communications device incorporating the inventive antenna is shown generally at 100. The wireless communications device 100 includes a housing 102, generally made of plastic or other non-conductive material. Within the housing 102 is a printed circuit (PC) board 104 having transmit 106 and receive 108 circuitry mounted thereon, as well as other components and elements (not shown for clarity purposes). The receive circuitry 108 also includes a GPS receiver 110 so that the wireless communications device 100 may be utilized in GPS applications.

The wireless communications device 100 may be utilized in short-range applications using, for example, the well known Bluetooth protocol, and may also be utilized in long-range applications, such as, for example, GPS applications. For short-range Bluetooth applications, the transmit 106 and receive 108 circuitry may be incorporated into a wireless transceiver that wirelessly transmits and receives signals to and from a radio telephone. While Bluetooth applications require low power, they are only operable for short distance wireless communications. The Bluetooth protocol defines a universal radio interface in the 2.4–2.485 GHz frequency band that enables wireless electronic devices to connect and communicate wirelessly via short-range, ad hoc networks.

In long-range GPS applications, the GPS receiver 110 receives time-coded location-determining signals from GPS satellites (not shown) orbiting the Earth. Based on how long it took the satellite originating signals to reach the GPS receiver 110, the transmission speed of the signals, information regarding the satellite's orbit, and other pertinent information included within the signals, the GPS receiver 110 determines the location of the wireless communications device 100. Location determination in GPS systems utilizing GPS receivers is well known.

The wireless communications device 100 further includes an antenna 112 for transmitting and receiving radio frequency (RF) signals. The antenna 112 is formed on the inner surface of the housing 102 and is operably connected to the transmit 106 and receive 108 circuitry via a coupling plate 116. The coupling plate 116 is mounted to the PC board 104 by a spacing element 118 which spaces the coupling plate 116 from the PC board 104. The spacing element 118 is made of a conductive material and directly connects the coupling element 116 to the transmit 106 and receive 108 circuitry so that the coupling plate 116 receives a direct RF feed. While the coupling plate 116 is shown connected to the transmit 106 and receive 108 circuitry via a connection path 119, a duplexer, a transmit/receive switch, or other similar device will typically be provided between the transmit 106 and receive 108 circuitry and the antenna 112. The coupling plate 116 is spaced from the antenna 112 formed on the inner surface of the housing 102. The only connection between the coupling plate 116 and the antenna 112 is via capacitive coupling therebetween.

The antenna 112 is formed on the inner surface of the housing 102 by methods such as plating, vacuum evaporation, adhering a metal plate onto the inner surface of the housing 102, or other conventional means. The antenna 112 includes first 120 and second 122 antenna elements. The first 120 and second 122 antenna elements are geometrically configured different for different applications, such as, for example, short-range Bluetooth applications or long-range GPS applications. The first 120 and second 122 antenna elements are geometrically configured for impedance matching with the transmit 106 and receive 108 circuitry for operation in a select frequency bandwidth. The coupling plate 116 is disposed over the first antenna element 120 and is typically of the same geometric configuration. For example, if the coupling plate 116 is of a square configuration, the first antenna element 120 would also be a square configuration; if the coupling plate 116 is circular, the first antenna element 120 will also be circular; if the coupling plate 116 is configured as a triangle, the first antenna elements 120 will also be configured as a triangle; etc. While the coupling plate 116 and the first antenna element 120 are of the same geometric configuration, they do not necessarily have to be the same size. The size and geometric configuration of the coupling plate 116 and the first antenna element 120 may vary from application to application.

Figure 2:
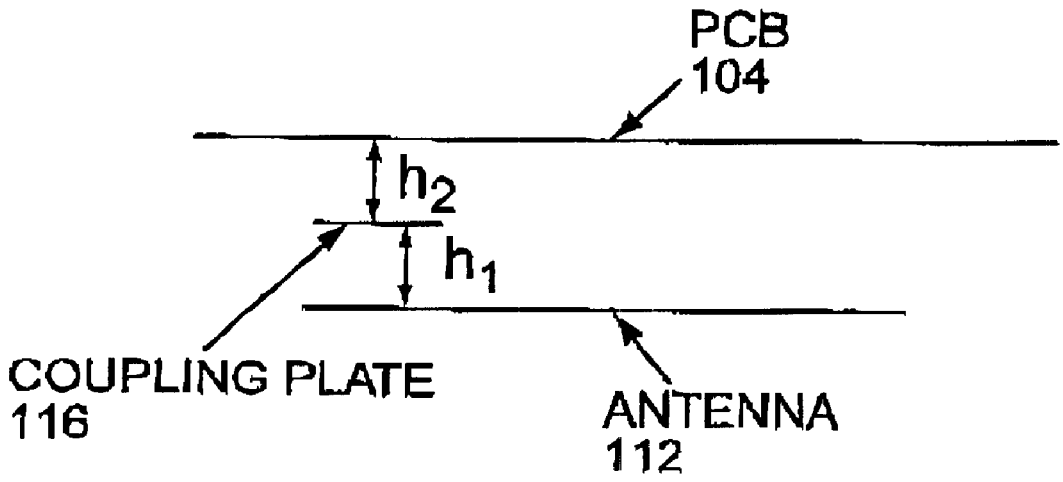
FIG. 2 is a spacing diagram of the inventive antenna shown in FIG. 1.

As shown in the spacing diagram of FIG. 2, the antenna 112 is spaced from the coupling plate 116, which in turn is spaced from the printed circuit board 104. While the coupling plate 116 is directly connected to the printed circuit board 104, and the transmit 106 and receiver 108 circuitry, by the spacing element 118, the coupling plate 116 is only capacitively coupled to the antenna 112 via air or some other dielectric therebetween. The antenna 112 is spaced from the coupling plate 116 by a distance $h_1$. Similarly, the coupling plate 116 is spaced from the printed circuit board 104 by a distance $h_2$. In exemplary forms, when the wireless communications device 100 is desired for use in either Bluetooth or GPS applications, the distance $h_1$, may vary between 1–3 millimeters and the distance $h_2$ may range between 1–4 millimeters. These spatial distances, however, are by no means meant to be all inclusive, and greater or lesser spatial distances for $h_1$ and $h_2$ may be implemented depending upon the desired application and/or the geometric configuration of the antenna 112 without departing from the spirit and scope of the present invention.

Figure 3:
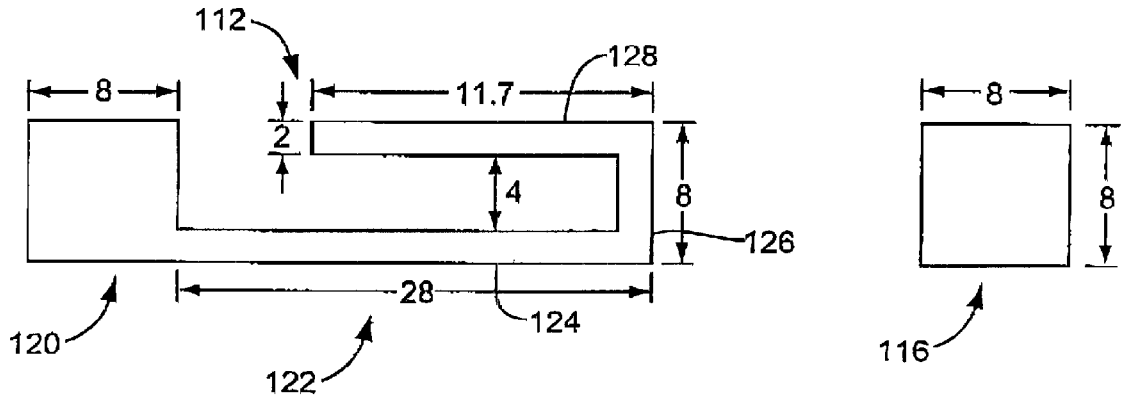
FIG. 3 illustrates the geometric configuration of the antenna and coupling plate for a first embodiment of the inventive antenna.
Figure 4:
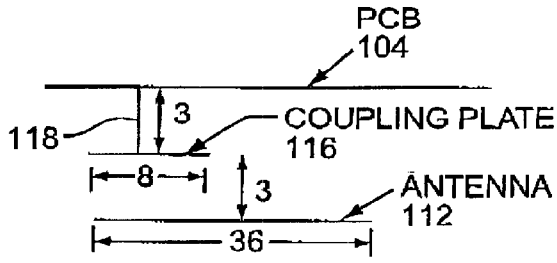
FIG. 4 illustrates the spacing of the antenna and coupling plate shown in FIG. 3.

FIGS. 3–4 illustrate the geometric configuration and spacing of the antenna 112 and the coupling plate 116 for use in Bluetooth applications. Both the first antenna element 120 and the coupling plate 116 are square in shape and have 8 mm by 8 mm dimensions. The second antenna element 122 is generally U-shaped opening toward the first antenna element 120. The second antenna element 122 includes a first arm of the U 124 extending from the first antenna element 120 a distance of 28 millimeters, with a base 126 extending 8 millimeters, and a second arm of the U 128 extending back toward the first antenna element 120 a distance of 11.7 millimeters. Both the first 124 and second 128 arms and the base 126 of the U-shaped second antenna element 122 are 2 millimeters wide. In this particular application, as shown in FIG. 4, the coupling plate 116 is spaced a distance of 3 millimeters from the printed circuit board 104, with the antenna 112 spaced a distance of 3 millimeters from the coupling plate 116.

Figure 5:
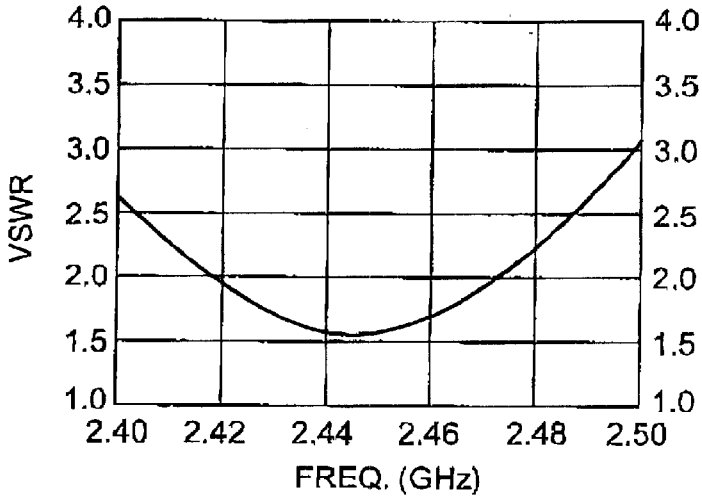
FIG. 5 is a graph of simulated VSWR versus frequency data for the first embodiment of the inventive antenna configuration shown in FIGS. 3–4.

FIG. 5 is a graph of simulated Voltage Standing Wave Ratio (VSWR) data versus frequency for the antenna 112 and coupling plate 116 configuration shown in FIGS. 3–4. The VSWR is a ratio of the amplitude of the electric field or voltage at a voltage minimum to that at an adjacent maximum in a stationary wave system. The VSWR value is an expression of the impedance mismatch in the antenna resulting in signal reflection. The higher the value of the VSWR at a given frequency, the more signal loss that occurs as a result of signal reflection. Thus, it is desirable to have a low value for VSWR within a given frequency band. The lower the VSWR value, the less signal loss that occurs, resulting in improved signal transmission.

As shown in the graph of simulated VSWR versus frequency data in FIG. 5, the antenna 112 and coupling plate 116 configuration illustrated in FIGS. 3–4 works fine in the Bluetooth bandwidth of 2.4–2.485 GHz with a VSWR value equal to or less than 2.6:1. A VSWR value of 2.6 or lower within the 2.4–2.485 GHz bandwidth results in sufficient signal strength for operation within that bandwidth.

Figure 6:
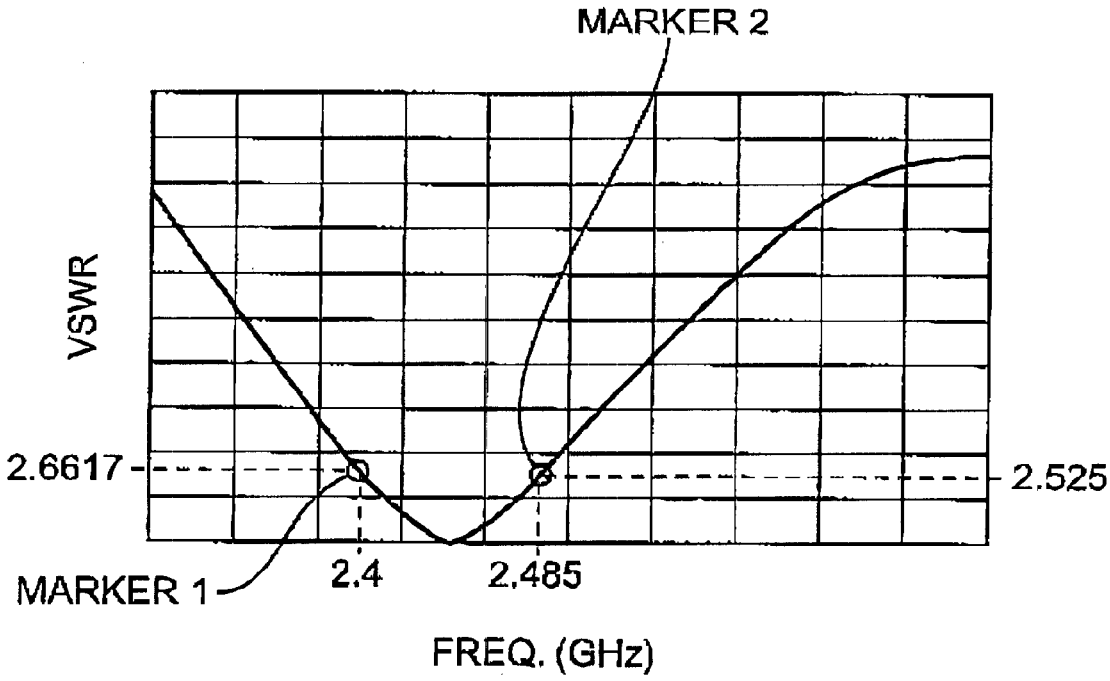
FIG. 6 is a graph of measured VSWR versus frequency data for the first embodiment of the inventive antenna configuration shown in FIGS. 3–4.

FIG. 6, which is a graph of the measured VSWR versus frequency characteristics of the antenna 112 and coupling plate 116 configuration shown in FIGS. 3–4, confirms the simulated operational data shown in FIG. 5. At marker 1 in FIG. 6, which represents 2.4 GHz, the measured VSWR value is 2.6617. At marker 2 in FIG. 6, which represents 2.485 GHz, the measured VSWR value is 2.525. Thus, FIG. 6 confirms that the antenna 112 and coupling plate 116 configuration shown in FIGS. 3–4 works within 2.6:1 VSWR in the Bluetooth bandwidth of 2.4–2.485 GHz.

Figure 7:
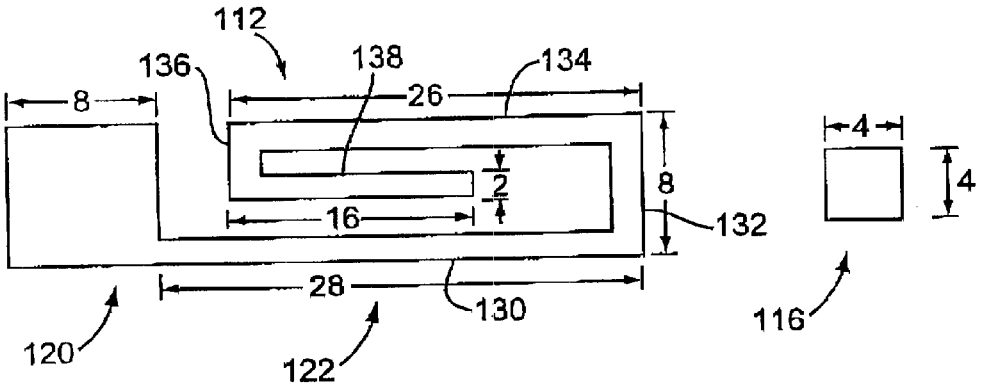
FIG. 7 illustrates the geometric configuration of the antenna and coupling plate for a second embodiment of the inventive antenna.
Figure 8:
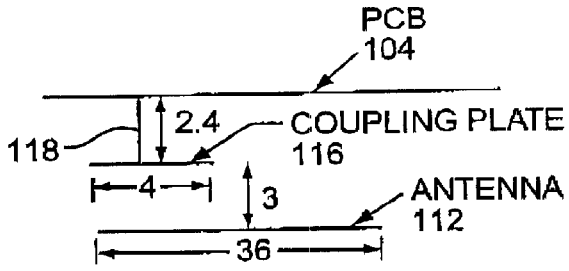
FIG. 8 illustrates the spacing of the antenna and coupling plate shown in FIG. 7.

FIGS. 7–8 illustrate the geometric construction and spacing of the antenna 112 and the coupling plate 116 for use in GPS applications at 1.57542 GHz. The first antenna element 120 and the coupling plate 116 are both square in shape. However, the first antenna element 120 has an 8 mm by 8 mm dimension, while the coupling plate 116 is dimensioned 4 mm by 4 mm. The second antenna element 122 occupies a total length of 28 millimeters and has a total width of 8 millimeters. The second antenna element 122 has a first element 130 extending from an edge of the first antenna element 120 and extending generally parallel therewith for 28 millimeters, a second element 132 extending perpendicular to the first element 130 for 8 millimeters, a third element 134 extending perpendicular to the second element 132 and parallel to the first element 130 back toward the first antenna element 120 for 26 millimeters, a fourth element 136 extending perpendicular to the third element 134 down toward the first element 130, and a fifth element 138 extending perpendicular to the fourth element 136 and parallel to the first 130 and third 134 elements toward the second element 132 for 16 millimeters. Each of the first through fifth elements has a width of 2 millimeters.

As shown in FIG. 8, the coupling plate 116 is spaced 2.4 millimeters from the PC board 104, with the antenna 112 spaced 3 millimeters from the coupling plate 116.

Figure 9:
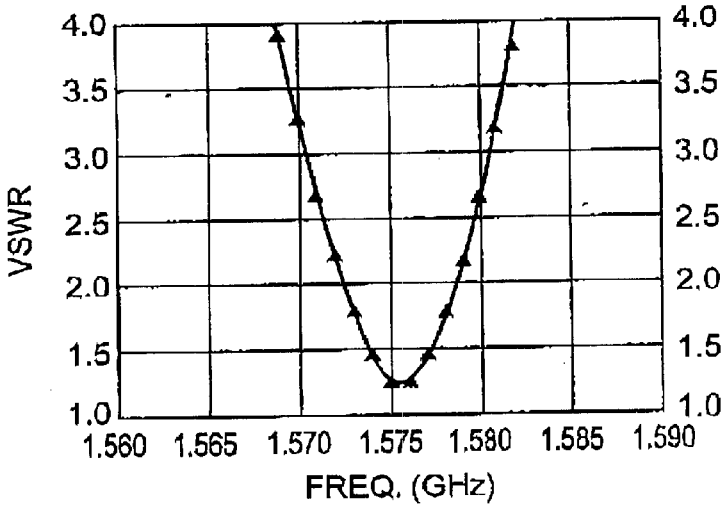
FIG. 9 is a graph of simulated VSWR versus frequency data for the second embodiment of the inventive antenna configuration shown in FIGS. 7–8.

FIG. 9, which is a graph of simulated VSWR versus frequency data, illustrates that the antenna 112 and coupling plate 116 configuration shown in FIGS. 7–8 will work in GPS applications and achieve resonance at approximately 1.575 GHz. As shown in FIG. 9, the antenna 112 and coupling plate 116 configuration has approximately an 8 MHz bandwidth with a 2.5:1 VSWR value, and approximately a 10 MHz bandwidth for a 3:1 VSWR value. Thus, the simulated VSWR values shown in FIG. 9 illustrate that the antenna 112 and coupling plate 116 configuration shown in FIGS. 7–8 will work sufficiently for GPS applications at 1.57542 GHz.

Figure 10:
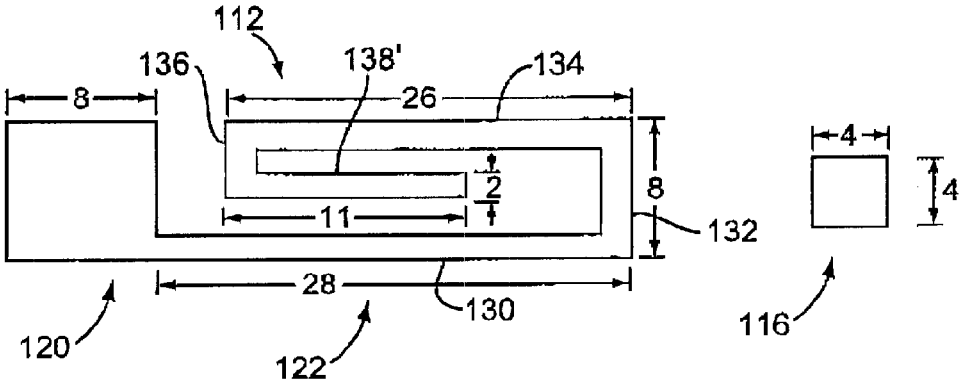
FIG. 10 illustrates the geometric configuration of the antenna and coupling plate for a third embodiment of the inventive antenna.
Figure 11:
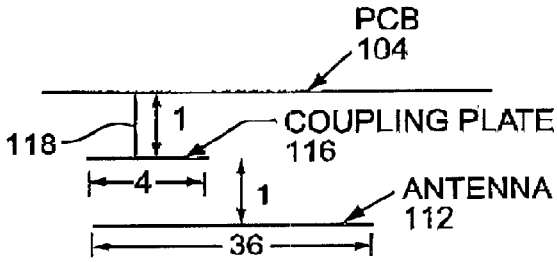
FIG. 11 illustrates the spacing of the antenna and coupling plate shown in FIG. 10.

FIGS. 10–11 illustrate an alternate geometric construction and spacing of the antenna 112 and the coupling plate 116 for GPS applications at 1.57542 GHz. The first antenna element 120 and the coupling plate 116 are again square in shape, with the first antenna element 120 dimensioned 8 mm by 8 mm and the coupling plate 116 dimensioned 4 mm by 4 mm. The second antenna element 122 has the same configuration as shown in FIG. 7, with the exception that the fifth element 138' extends only 11 millimeters back toward the second element 132. Also, as shown in FIG. 11, the coupling plate 116 is spaced only 1 millimeter from the printed circuit board 104, and the antenna 112 is spaced only 1 millimeter from the coupling plate 116.

Figure 12:
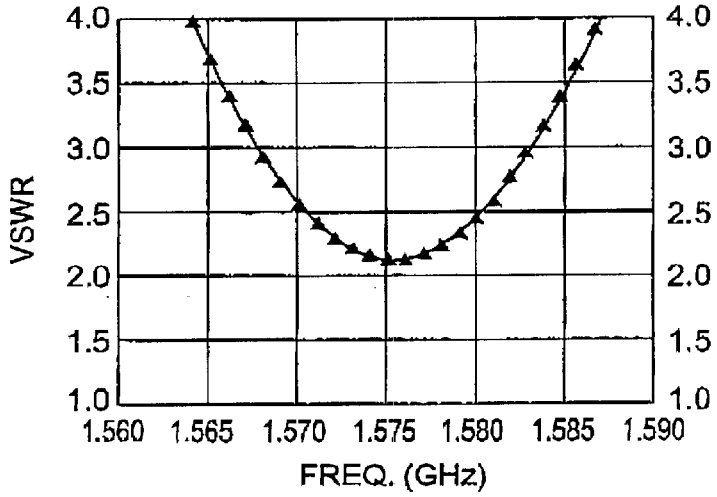
FIG. 12 is a graph of simulated VSWR versus frequency data for the third embodiment of the inventive antenna configuration show in FIGS. 10–11.

FIG. 12, which is a graph of simulated VSWR versus frequency data, illustrates that the antenna 112 and coupling plate 116 configuration shown in FIGS. 10–11 will work for GPS applications at 1.57542 GHz. As shown in FIG. 12, the bandwidth for a VSWR value of 2.5:1, is approximately 10 MHz. This is sufficient for the antenna 112 and coupling plate 116 configuration to operate in GPS applications at 1.57542 GHz.

While the present invention has been described with particular reference to the drawings, it should be understood that various modifications could be made without departing from the spirit and scope of the present invention. For example, numerous other antenna 112 and coupling plate 116 geometric configurations and spacings may be utilized for specific applications without departing from the spirit and scope of the present invention. The present invention has the advantage that the antenna 112 is not directly coupled to the RF circuitry on the printed circuit board 104, and accordingly, the complexities such as the inclusion of impedance matching elements required for direct connection can be avoided.

I claim:

1. A wireless communications device comprising:

a housing;

a transmitting and receiving antenna built into the housing, said antenna comprising a first antenna element with a first geometric shape and a second antenna element with a second geometric shape;

receive and transit circuitry within the housing for receiving and transmitting radio signals via the antenna; and a coupling plate within the housing connected to the receive and transmit circuitry and spaced from the first antenna element by a distance $h_1$, wherein received and transmitted radio signals are transferred between the antenna and the receive and transmit circuitry only by capacitive coupling between the first antenna element and the coupling plate; and wherein said distance h1, said first geometric shape, and said second geometric shape are selected so as to match an impedance of said antenna to said receive and transmit circuitry.

2. The wireless communications device of claim 1, wherein the distance $h_1$ equals 1–3 mm.

3. The wireless communications device of claim 1, wherein the antenna is formed on an inner surface of the housing.

4. The wireless communications device of claim 3, wherein the antenna is formed on the inner surface of the housing by at least one of plating, vacuum evaporation, and adhering a metal plate onto the inner surface of the housing.

5. The wireless communications device of claim 1, wherein the first antenna element is formed on the housing at a position corresponding to the coupling plate.

6. The wireless communications device of claim 5, wherein the coupling plate has the same geometric shape as the first antenna element.

7. The wireless communications device of claim 6, wherein the first geometric shape is selected from the group consisting of a polygon and an ellipse.

8. The wireless communications device of claim 1, wherein the antenna and coupling plate are geometrically configured and spaced to operate in a select frequency bandwidth.

9. The wireless communications device of claim 1, further comprising a printed circuit board within the housing including the receive and transmit circuitry, wherein the coupling plate is spaced from the printed circuit board by a distance $h_2$.

10. The wireless communications device of claim 9, wherein the distance $h_2$ equals 1–4 mm.

11. A wireless communications device for transmitting and receiving radio frequency (RF) signals, the wireless communications device comprising:

a housing;

receive and transmit circuitry within the housing for receiving and transmitting RF signals;

only one reception and transmission antenna, said antenna built into the housing, wherein said antenna comprises a first antenna element with a first geometric shape and a second antenna element with a second geometric shape; and a coupling plate within the housing connected to the receive and transmit circuitry and spaced from the first antenna element by a distance $h_1$, wherein received and transmitted RF signals are transferred between the antenna and the receive and transmit circuitry only by capacitive coupling between the first antenna element and the coupling plate; and wherein said distance h1, said first geometric shape, and said second geometric shape are selected so as to match an impedance of said antenna to said receive and transmit circuitry.

12. The wireless communications device of claim 11, wherein the antenna is formed on an inner surface of the housing by at least one of plating, vacuum evaporation, and adhering a metal plate onto the inner surface of the housing.

13. The wireless communications device of claim 11, wherein the distance $h_1$ equals 1–3 mm.

14. The wireless communications device of claim 11, wherein the first antenna element is formed on the housing at a position corresponding to the coupling plate.

15. The wireless communications device of claim 14, wherein the coupling plate has the same geometric shape as the first antenna element.

16. The wireless communications device of claim 15, wherein the first geometric shape is selected from the group consisting of a polygon and an ellipse.

17. The wireless communications device of claim 11, further comprising a printed circuit board within the housing including the receive and transmit circuitry, wherein the coupling plate is spaced from the printed circuit board by a distance $h_2$.

18. The wireless communications device of claim 17, wherein the distance $h_2$ equals 1–4 mm.

19. The wireless communications device of claim 11, wherein the antenna is spaced from the coupling plate to operate in a select frequency bandwidth.

* * * * *